US011705656B2

(12) United States Patent
Nakagawa et al.

(10) Patent No.: US 11,705,656 B2
(45) Date of Patent: Jul. 18, 2023

(54) CONNECTER TERMINAL STRUCTURE

(71) Applicant: YAZAKI CORPORATION, Tokyo (JP)

(72) Inventors: Masahiro Nakagawa, Makinohara (JP); Syoichi Nomura, Makinohara (JP); Hideki Mizuno, Kakegawa (JP); Yasuhiro Yamaguchi, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 43 days.

(21) Appl. No.: 17/539,087

(22) Filed: Nov. 30, 2021

(65) Prior Publication Data

US 2022/0173541 A1 Jun. 2, 2022

(30) Foreign Application Priority Data

Dec. 2, 2020 (JP) ..... 2020-200281

(51) Int. Cl.

| | |
|---|---|
| ***H01R 13/17*** | (2006.01) |
| ***H01R 13/04*** | (2006.01) |
| ***H01R 13/422*** | (2006.01) |
| *H01R 13/10* | (2006.01) |

(52) U.S. Cl.

CPC ..... *H01R 13/17* (2013.01); *H01R 13/04* (2013.01); *H01R 13/422* (2013.01); *H01R 13/10* (2013.01)

(58) Field of Classification Search

CPC ..... H01R 13/17

See application file for complete search history.

(56) References Cited

U.S. PATENT DOCUMENTS

| | | | | |
|---|---|---|---|---|
| 6,336,821 | B1 * | 1/2002 | Hattori | H01R 13/6277 439/282 |
| 9,293,849 | B2 * | 3/2016 | Balsells | H01R 13/03 |
| 2006/0127170 | A1 | 6/2006 | Balsells | |
| 2013/0045630 | A1 | 2/2013 | Natter | |
| 2016/0134044 | A1 | 5/2016 | Hirakawa et al. | |

FOREIGN PATENT DOCUMENTS

| | | | |
|---|---|---|---|
| JP | 2008-204634 | A | 9/2008 |
| JP | 2015-28900 | A | 2/2015 |

* cited by examiner

*Primary Examiner* — Ross N Gushi

(74) *Attorney, Agent, or Firm* — Kenealy Vaidya LLP

(57) ABSTRACT

A connecter terminal structure includes: a male housing of a male connecter; a male terminal accommodated in the male housing and including a first electrical contact portion; a stepped shaft portion formed at a tip end of the first electrical contact portion; a hood portion surrounding the first electrical contact portion; an annular terminal spring externally fitted to the stepped shaft portion; and an insulating cap fixed to a tip end of the stepped shaft portion and configured to hold the annular terminal spring. The connecter terminal structure further includes: a female housing of a female connecter; a female terminal accommodating portion configured to be fitted into the hood portion; and a female terminal accommodated in the female terminal accommodating portion and including a second electrical contact portion having a tubular shape to allow the first electrical contact portion to be inserted therein.

2 Claims, 9 Drawing Sheets

CONNECTER TERMINAL STRUCTURE

CROSS-REFERENCE TO RELATED APPLICATIONS

This application is based on and claims the benefit of priority of Japanese Patent Application No. 2020-200281 filed on Dec. 2, 2020, the entire contents of which are incorporated herein by reference.

FIELD

The present disclosure relates to a connecter terminal structure.

BACKGROUND

A high-voltage connecter used in an electrically powered vehicle such as an electric vehicle or a hybrid vehicle is divided into a female connecter and a male connecter. A male terminal and a female terminal that can be energized and inserted or removed are respectively accommodated in the male connecter and the female connecter, and the male terminal and the female terminal are electrically connected via a terminal spring. More specifically, the bar-shaped male terminal is accommodated in the male connecter. The tubular female terminal is accommodated in the female connecter. Then, the terminal spring is assembled inside the female terminal (see JP-A-2015-028900).

The terminal spring to be assembled to the female terminal is held by being assembled to a holding groove formed by cutting and machining an inner wall surface of the female terminal in a circumferential direction or attaching a cover from an outside so as not to move in the female terminal or come out of the female terminal.

As disclosed in JP-A-2008-204634, there is also proposed a contact device in which a groove is provided on an outer peripheral surface of a small diameter portion (male terminal) of a conductor along a circumferential direction, and a spring contact (annular terminal spring) obtained by a coil spring being bent in an annular shape with both end portions being joined is fitted.

SUMMARY

However, since the female terminal in which the holding groove is formed as in JP-A-2015-028900 is assembled with the terminal spring, the terminal itself has a complicated shape, which makes a cutting and machining operation difficult. In addition, since the male terminal needs to be brought into contact in displacement of the terminal spring on a female terminal side, it is necessary to perform processing with high accuracy, and like the female terminal, it is difficult to perform the cutting and machining operation. In a structure in which the terminal spring is assembled inside the female terminal, the holding groove of the terminal spring must be formed from a tip end of the female terminal to a rear side at a predetermined distance or more, and thus there is a problem that a length of the female terminal becomes longer by that amount.

As in the contact device of JP-A-2008-204634, when the spring contact (the annular terminal spring) is fitted into a groove provided on the outer peripheral surface of the male terminal, there is a possibility that an operation of mounting the annular terminal spring in the groove is generated after a diameter of the annular terminal spring is increased, and damage or the like to an electrical contact portion of the male terminal occurs.

The present disclosure has been made in view of the above circumstances, and an object thereof is to provide a connecter terminal structure which can reduce processing cost of a terminal by simplifying a shape of a female terminal and can shorten a length of a male-female connecter in a fitting direction at the time of fitting by eliminating a holding groove of the female terminal.

The present disclosure provides a connecter terminal structure including: a male housing of a male connecter; a male terminal accommodated in the male housing, the male terminal having a bar shape and including a first electrical contact portion; a stepped shaft portion formed at a tip end of the first electrical contact portion of the male terminal; a hood portion formed in the male housing and surrounding the first electrical contact portion; an annular terminal spring including a coil spring having conductivity and being bent in an annular shape with both end portions being joined, the annular terminal spring being externally fitted to the stepped shaft portion; an insulating cap fixed to a tip end of the stepped shaft portion and configured to hold the annular terminal spring; a female housing of a female connecter; a female terminal accommodating portion formed in the female housing and configured to be fitted into the hood portion; and a female terminal accommodated in the female terminal accommodating portion and including a second electrical contact portion, the second electrical contact portion having a tubular shape to allow the first electrical contact portion to be inserted therein.

According to the connecter terminal structure of the present disclosure, the processing cost of the terminal can be reduced by simplifying a shape of the female terminal and a length of the male-female connecter in the fitting direction at the time of the fitting can be shortened by eliminating the holding groove of the female terminal.

The present disclosure has been briefly described above. Further, details of the present disclosure will be clarified by reading an aspect (hereinafter, referred to as an "embodiment") for implementing the disclosure to be described below with reference to the accompanying drawings.

DETAILED DESCRIPTION

Hereinafter, an embodiment according to the present disclosure will be described with reference to the drawings.

Figure 1A:
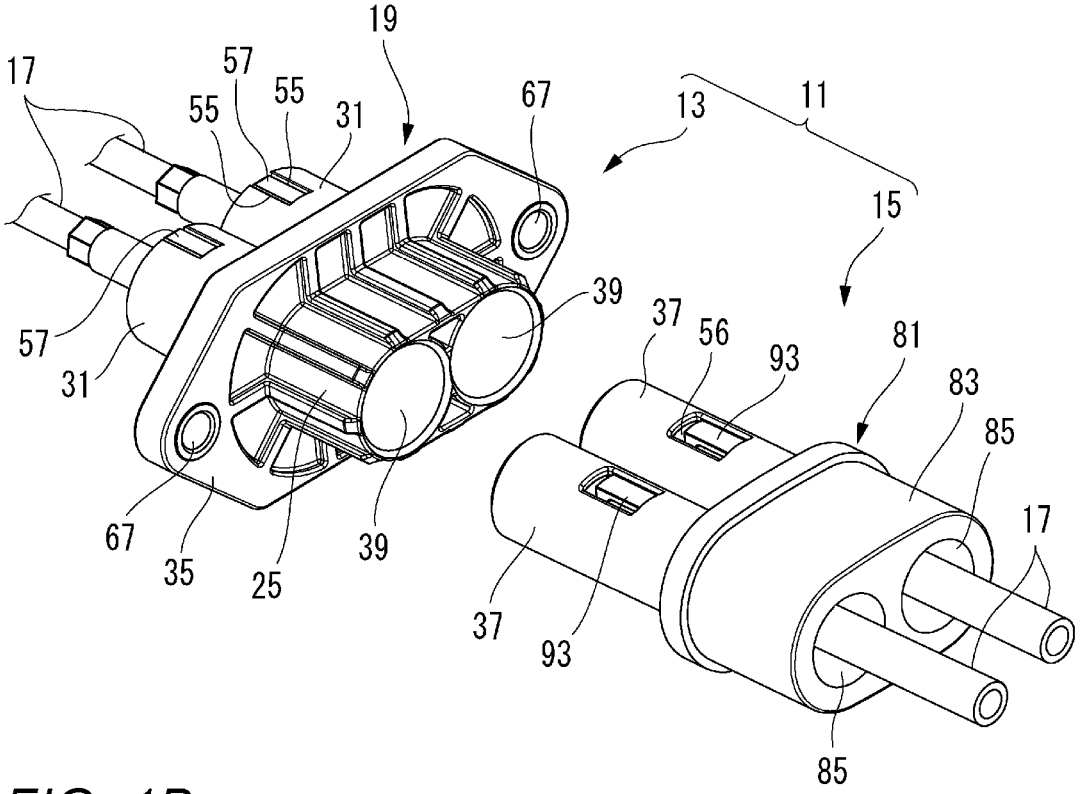
FIG. 1A is a perspective view before fitting of a male-female connecter having a connecter terminal structure according to an embodiment of the present disclosure.
Figure 1B:
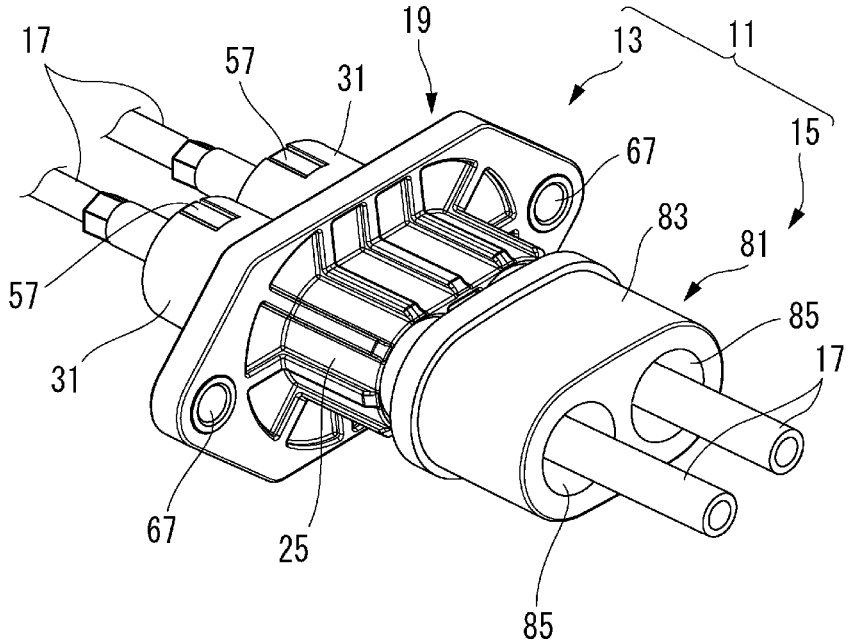
FIG. 1B is a perspective view after the fitting.
Figure 2A:
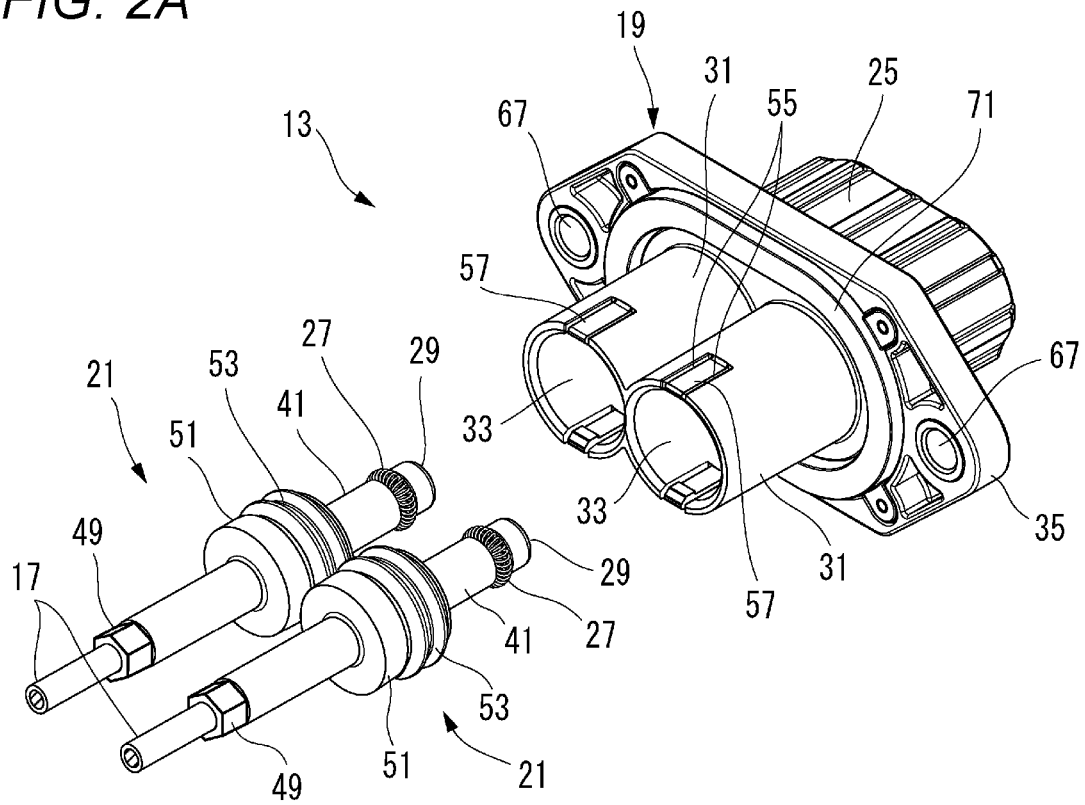
FIG. 2A is an exploded perspective view of a male connecter.
Figure 2B:
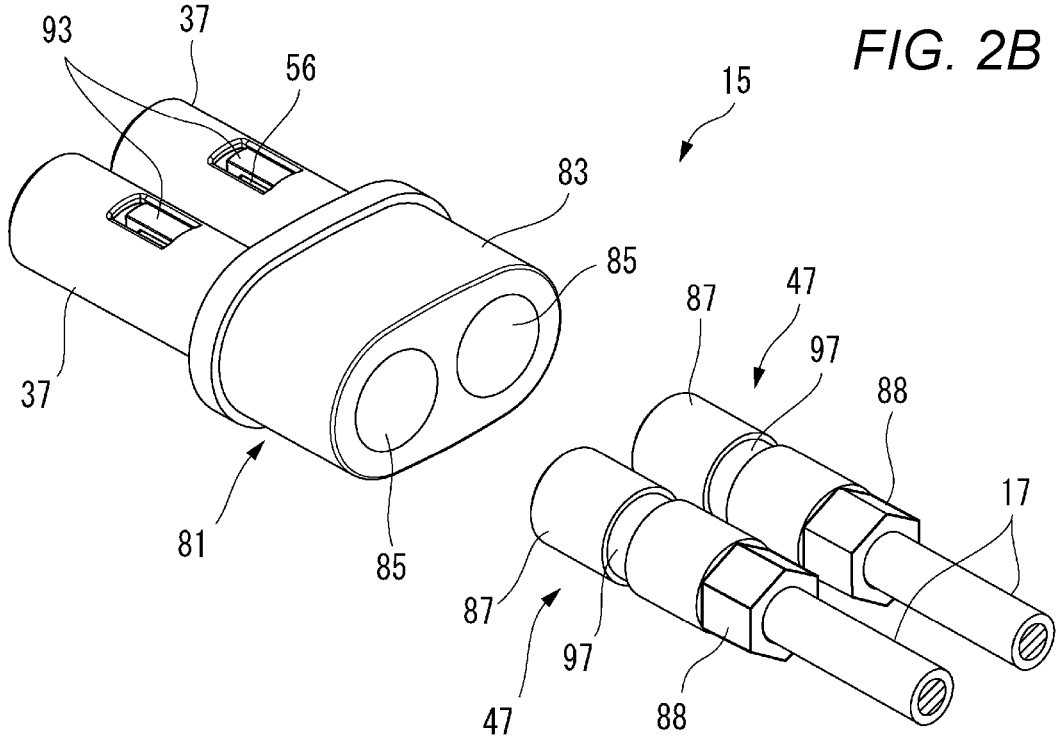
FIG. 2B is an exploded perspective view of a female connecter.

FIG. 1A is a perspective view before fitting of a male-female connecter 11 having a connecter terminal structure according to the embodiment of the present disclosure, and FIG. 1B is a perspective view after the fitting. FIG. 2A is an exploded perspective view of a male connecter 13, and FIG. 2B is an exploded perspective view of a female connecter 15.

The connecter terminal structure according to the present embodiment is used for the male-female connecter 11. As shown in FIGS. 1A and 1B, the male-female connecter 11 includes the male connecter 13 and the female connecter 15. The male-female connecter 11 is used, for example, in an electric vehicle. In the electric vehicle, an inverter (not shown) that converts DC power from a battery (not shown) into AC power and supplies the AC power is connected to a three-phase AC motor (not shown). A high-voltage electric wire 17 with a connecter connects the battery and the inverter, the inverter and the motor, and the like. In the present embodiment, the male connecter 13 is attached to, for example, the inverter, and the female connecter 15 is connected to the high-voltage electric wire 17.

The male-female connecter 11 is a high voltage two-pole type waterproof shielded connecter of a device fixed type. Although the male-female connecter 11 according to the present embodiment has a shield structure for shielding an electromagnetic wave and grounding, a description of the shield structure is omitted because the shield structure is not an essential configuration of the present disclosure.

As shown in FIGS. 1A to 2B, the male connecter 13 mainly includes a male housing 19, a male terminal 21, a stepped shaft portion 23 (see FIG. 4A) formed on the male terminal 21, an annular terminal spring 27, and an insulating cap 29.

The male housing 19 further includes a male housing body portion 31, a male terminal accommodating chamber 33, a fixing plate portion 35, and a hood portion 25. The male housing 19 forms an outer shell of the male connecter 13.

The male housing body portion 31 is formed of a resin material having electrical insulation property. The male housing body portion 31 is formed by integrally connecting two cylindrical portions that have the same axial direction sharing one partition wall along a generatrix. That is, two cylindrical spaces are partitioned by the partition wall and disposed adjacent to each other in the male housing body portion 31. Each cylindrical space is opened in a front and rear in a direction along an axis. In the present specification, the "front" refers to a fitting side in each connecter, and the "rear" refers to a terminal insertion side in each connecter.

Figure 3:
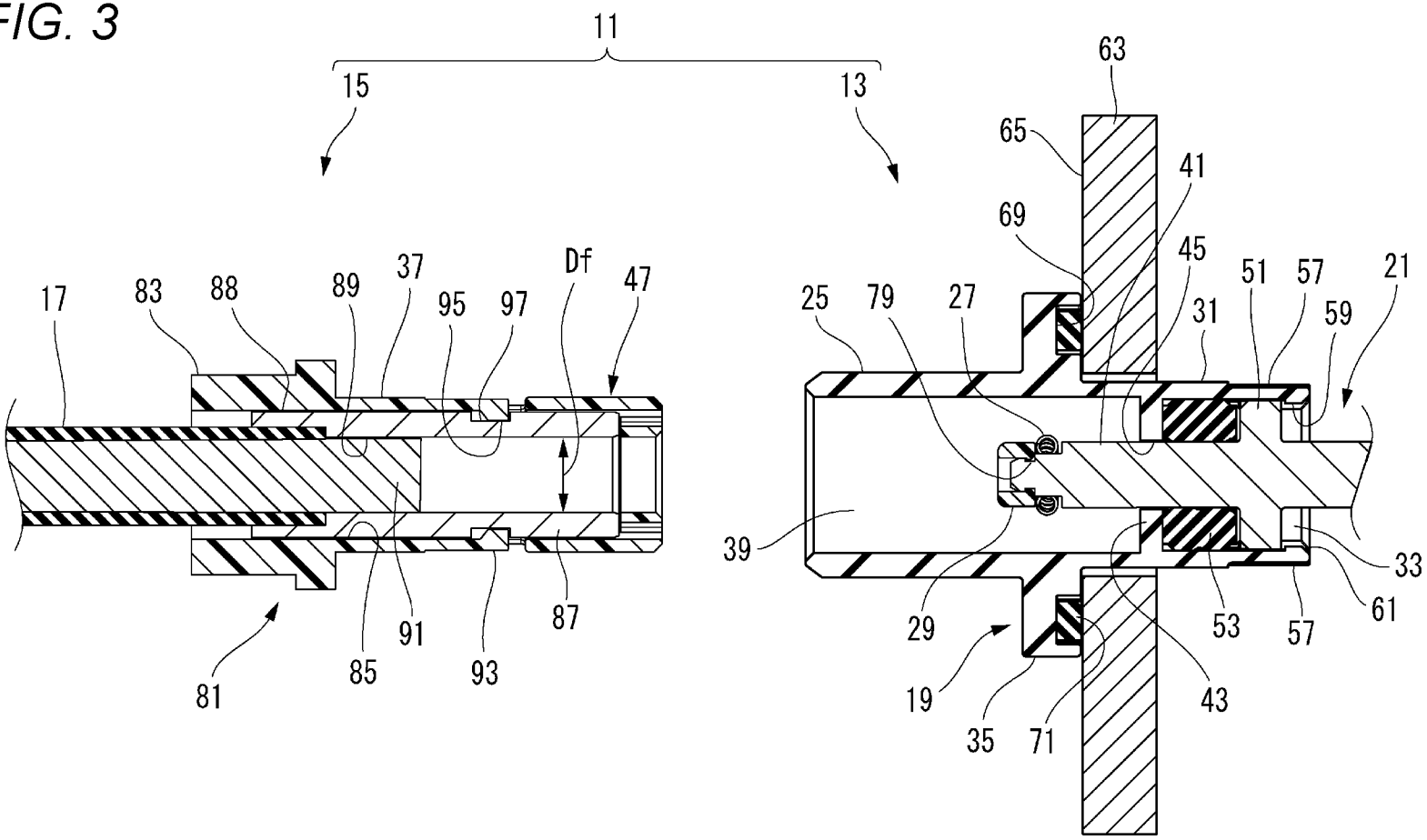
FIG. 3 is a longitudinal cross-sectional view of the male-female connecter before the fitting.

FIG. 3 is a longitudinal cross-sectional view of the male-female connecter 11 before the fitting.

The tubular hood portion 25 extends from a front portion of the male housing body portion 31. An inner side of the hood portion 25 serves as a fitting space 39 into which a female terminal accommodating portion 37 of the female connecter 15 is fitted. That is, the hood portion 25 surrounds an electrical contact portion 41 of the male terminal 21 accommodated in the male terminal accommodating chamber 33 via the fitting space 39. In the male housing body portion 31, an outer periphery of a rear cylindrical space serves as a body outer peripheral portion. An inner side of the body outer peripheral portion serves as the male terminal accommodating chamber 33.

The male terminal accommodating chamber 33, which is a cylindrical space, is partitioned by a disc-shaped resin wall 43. A concentric terminal through hole 45 is formed in the resin wall 43. The electrical contact portion 41 of the male terminal 21 is inserted into the terminal through hole 45.

The male terminal 21 made of conductive metal is accommodated in the male terminal accommodating chamber 33. A tip end side of the male terminal 21 serves as the electrical contact portion 41 formed in a round bar shape. The tapered insulating cap 29 that guides the fitting with a female terminal 47 is attached to a tip end of the electrical contact portion 41. The insulating cap 29 is formed of a synthetic resin having the electrical insulation property, and has a finger touch prevention function in the male terminal 21. The male terminal 21 has an electric wire connecting portion 49 that extends rearward from the electrical contact portion 41 with the same axis and the same outer diameter as that of the electrical contact portion 41. In the male terminal 21, a disc-shaped flange portion 51 protruding outward in a radial direction is integrally formed between the electrical contact portion 41 and the electric wire connecting portion 49. The flange portion 51 is loosely fitted inside the male terminal accommodating chamber 33.

In the male terminal 21, a terminal packing 53, which is an annular seal member, is externally fitted to the electrical contact portion 41 on a front side relative to the flange portion 51. On an inner peripheral side of the terminal packing 53, terminal-side lip portions that are in close contact with an outer periphery of the electrical contact portion 41 are formed in multiple stages (two stages in the present embodiment) in the direction along the axis. On an outer peripheral side of the terminal packing 53, accommodating chamber side lip portions that are in close contact with an inner peripheral wall of the male terminal accommodating chamber 33 are formed in multiple stages (two stages in the present embodiment) in the direction along the axis. When the electrical contact portion 41 of the male terminal 21 is inserted into the terminal through hole 45 of the resin wall 43, the terminal packing 53 is sandwiched between the resin wall 43 and the flange portion 51 and is held in the male terminal accommodating chamber. Accordingly, the male connecter 13 prevents water from entering the male terminal accommodating chamber 33 from the fitting space 39.

A flexible locking piece 57 is formed on the body outer peripheral portion of the male housing body portion 31 by a pair of parallel slits 55 (see FIG. 1A) inserted in the direction along the axis. A rear end side of the body outer peripheral portion of the flexible locking piece 57 serves as a free end that is elastically displaceable toward inner and outer sides of the male terminal accommodating chamber 33. A locking projection 59 (see FIG. 3) protruding into the male terminal accommodating chamber 33 is formed at the free end. When the male terminal 21 is inserted into the male terminal accommodating chamber 33 from a rear, in the flexible locking piece 57, the flange portion 51 contacts a tapered surface 61 of the locking projection 59, and the flexible locking piece 57 is displaced to an outside of the male terminal accommodating chamber 33. When the male terminal 21 is inserted into a predetermined position, the locking projection 59 that moves over the flange portion 51 locks a rear surface of the flange portion 51 by an elastic restoring force of the flexible locking piece 57 (a state in FIG. 3), and rear detachment from the male terminal accommodating chamber 33 is regulated, and the male terminal 21 is held in the male terminal accommodating chamber 33.

The male terminal 21 is provided with a coaxial conductor connection hole (not shown) in the electric wire connecting portion 49. A conductor (not shown) of the high-voltage electric wire 17 routed in a device is conductively connected to the conductor connection hole by fixing such as crimping.

The male housing 19 is attached to an attached portion 63 such as a housing of the inverter. This attachment is performed by screwing with fasteners such as bolts and nuts. The fixing plate portion 35 fixed to the attached portion 63 is integrally formed in the male housing 19. The fixing plate portion 35 protrudes outward from an outer periphery of the male housing 19 so as to face an attached surface 65 of the attached portion 63. The fixing plate portion 35 is formed in a rectangular plate shape in which four corners are chamfered by inclined side portions (see FIGS. 1A and 1B), for example. A shape of the fixing plate portion 35 is not limited to a rectangle. The fixing plate portion 35 has a plate thickness capable of obtaining a sufficient fixing strength for fixing the male housing 19 to the attached portion 63.

A fastening hole portion 67 penetrating in a plate thickness direction is provided in the fixing plate portion 35. An annular packing accommodating groove 69 is formed on a surface of the fixing plate portion 35 facing the attached portion 63. An annular packing 71 is attached to the packing accommodating groove 69.

Figure 4A:
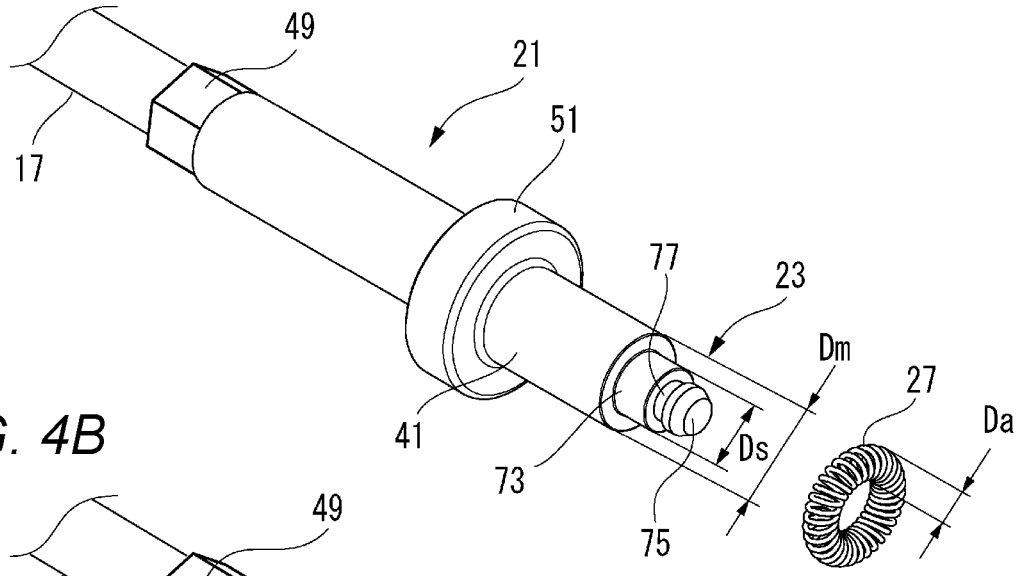
FIG. 4A is an exploded perspective view of a male terminal before an annular terminal spring is mounted.
Figure 4B:
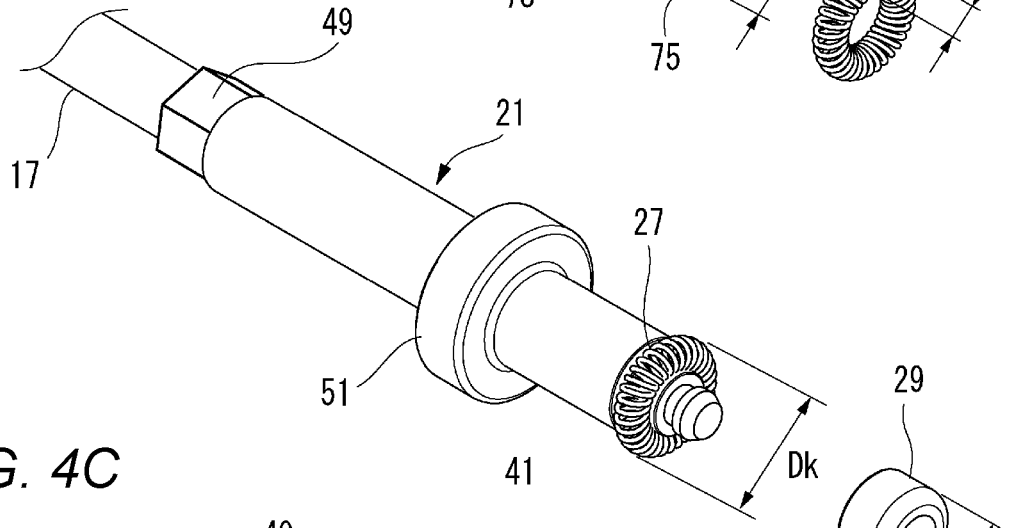
FIG. 4B is an exploded perspective view of the male terminal before the annular terminal spring is mounted and an insulating cap is fixed.
Figure 4C:
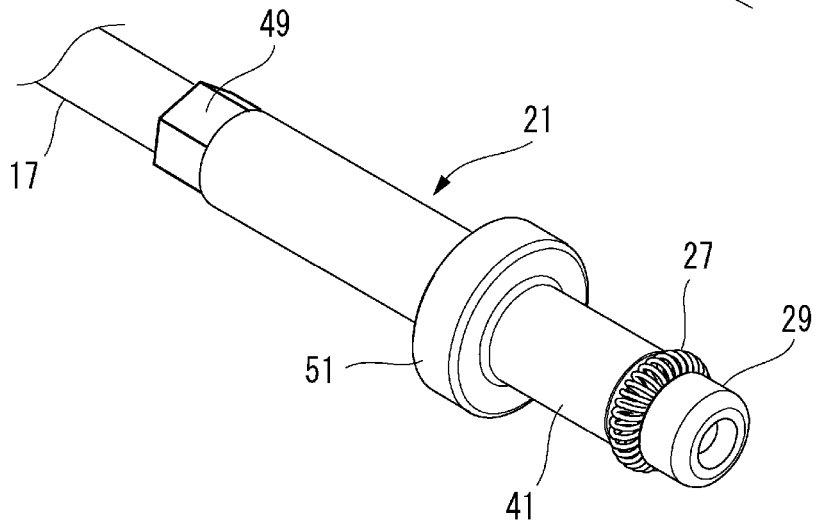
FIG. 4C is a perspective view of the male terminal to which the insulating cap is fixed.

FIG. 4A is an exploded perspective view of the male terminal 21 before the annular terminal spring 27 is mounted, FIG. 4B is an exploded perspective view of the male terminal 21 before the annular terminal spring 27 is mounted and the insulating cap 29 is fixed, and FIG. 4C is a perspective view of the male terminal 21 to which the insulating cap 29 is fixed.

As shown in FIG. 4A, the stepped shaft portion 23 is formed at the tip end of the electrical contact portion 41 of the male terminal 21. The stepped shaft portion 23 has a stepped shape by coaxially extending a spring external fitting shaft portion 73 forward, which is a small diameter portion having a diameter smaller than that of the columnar electrical contact portion 41, on a tip end side of the electrical contact portion 41. Therefore, an outer diameter Ds of the spring external fitting shaft portion 73 is smaller than an outer diameter Dm of the electrical contact portion 41 ($Ds<Dm$).

The annular terminal spring 27 obtained by a coil spring being bent in an annular shape with both end portions being joined is fitted (externally fitted) to an outer periphery of the spring external fitting shaft portion 73. Therefore, an outer diameter Dk of the annular terminal spring 27 externally fitted to the stepped shaft portion 23 is an average diameter Da of the coil spring×2+the outer diameter Ds of the spring external fitting shaft portion ($Dk=2Da+Ds$).

The insulating cap 29 made of an insulating resin is fixed to a tip end of the stepped shaft portion 23 to which the annular terminal spring 27 is externally fitted. The insulating cap 29 is fixed by, for example, a press-fitting structure provided over the spring external fitting shaft portion 73 and the insulating cap 29. An outer diameter Dc of the insulating cap 29 is larger than the outer diameter Ds of the spring external fitting shaft portion 73 and smaller than the outer diameter Dk of the annular terminal spring 27 ($Ds<Dc<Dk$). Accordingly, the annular terminal spring 27 is regulated from slipping forward from the stepped shaft portion 23 by the insulating cap 29 and is regulated from being deviated rearward by the stepped shaft portion 23, and is held by the spring external fitting shaft portion 73.

The stepped shaft portion 23 has a cap locking shaft portion 75 coaxial with the spring external fitting shaft portion 73 and extending toward the tip end side and having a diameter smaller than that of the spring external fitting shaft portion 73. A cap locking groove 77 is formed on the cap locking shaft portion 75 in a circumferential direction, and a fixing claw 79 (see FIG. 3) provided on an inner periphery of the insulating cap 29 formed in a tubular shape is locked to the cap locking groove 77. Accordingly, the insulating cap 29 is fixed to the tip end of the stepped shaft portion 23.

As shown in FIGS. 1A to 2B, the female connecter 15 mainly includes a female housing 81 and the female terminal 47. An outer shell of the female connecter 15 is formed by the female housing 81 made of resin.

The female housing 81 further includes a female housing body portion 83, a female terminal accommodating chamber 85, and the female terminal accommodating portion 37.

The female housing body portion 83 is formed of a resin material having the electrical insulation property. The female housing body portion 83 has an oval cross-sectional shape orthogonal to the axis. That is, a shape the female housing body portion 83 is an elliptical columnar shape. A pair of parallel female terminal accommodating chambers 85 having the same direction as an axis of a columnar space are formed in the female housing body portion 83 so as to be separated from each other in a direction along a long axis of the oval. A pair of female terminal accommodating portions 37 extend in a front side of the female housing body portion 83 in the fitting direction.

The female terminal accommodating portion 37 is formed such that two cylindrical portions having the same axial direction are separated from each other. Each cylindrical portion coaxially communicates with the female terminal accommodating chamber 85 positioned at a rear of the cylindrical portion. The female terminal accommodating portion 37 is inserted into each of a pair of fitting spaces 39 defined in the hood portion 25 of the male housing 19.

As shown in FIG. 2B, the female terminal 47 made of conductive metal is accommodated in the female terminal accommodating chamber 85 and the female terminal accommodating portion 37. The female terminal 47 is formed in a cylindrical shape into which the electrical contact portion 41 of the male terminal 21 is coaxially inserted. A terminal tip end portion of the female terminal 47 is an electrical contact portion 87 into which the electrical contact portion 41 of the male terminal 21 is inserted. An inner diameter Df of the electrical contact portion 87 is smaller than the outer diameter Dk of the annular terminal spring 27 ($Df<Dk$). That is, when the electrical contact portion 41 of the male terminal 21 to which the annular terminal spring 27 is externally fitted is inserted into the electrical contact portion 87, the female terminal 47 elastically deforms the annular terminal spring 27 in a reduced diameter direction, and is brought into conductive contact with the electrical contact portion 41 of the male terminal 21 with a predetermined pressing force via the annular terminal spring 27.

The female terminal 47 has an electric wire connecting portion 88 that extends rearward from the electrical contact portion 41 with the same axis and the same outer diameter as that of the electrical contact portion 41. The electric wire connecting portion 88 of the female terminal 47 is provided with a coaxial conductor connection hole 89 (see FIG. 3). A conductor 91 of the high-voltage electric wire 17 routed in a vehicle is conductively connected to the conductor connection hole 89 by fixing such as crimping.

A flexible locking piece 93 is formed in a front portion of the female terminal accommodating portion 37 by a substantially U-shaped slit 56 inserted in the direction along the axis. A tip end side of the flexible locking piece 93 serves as a free end that is elastically displaceable toward inner and outer sides of the female terminal accommodating chamber 85. A locking projection 95 (see FIG. 3) protruding inward is formed at the free end. When the female terminal 47 is inserted into the female terminal accommodating chamber 85 from the rear, the flexible locking piece 93 contacts a tip end of the female terminal 47 and is displaced to an outside of the female terminal accommodating chamber 85. When the female terminal 47 is inserted into a predetermined position, the locking projection 95 that moves over the tip end locks a circumferential groove 97 by an elastic restoring force of the flexible locking piece 93 (a state in FIG. 5), and rear detachment of the female terminal 47 from the female terminal accommodating chamber 85 is regulated, and the female terminal 47 is held in the female terminal accommodating chamber 85.

Next, a fitting operation of the male-female connecter 11 having the above configuration will be described.

Figure 5:
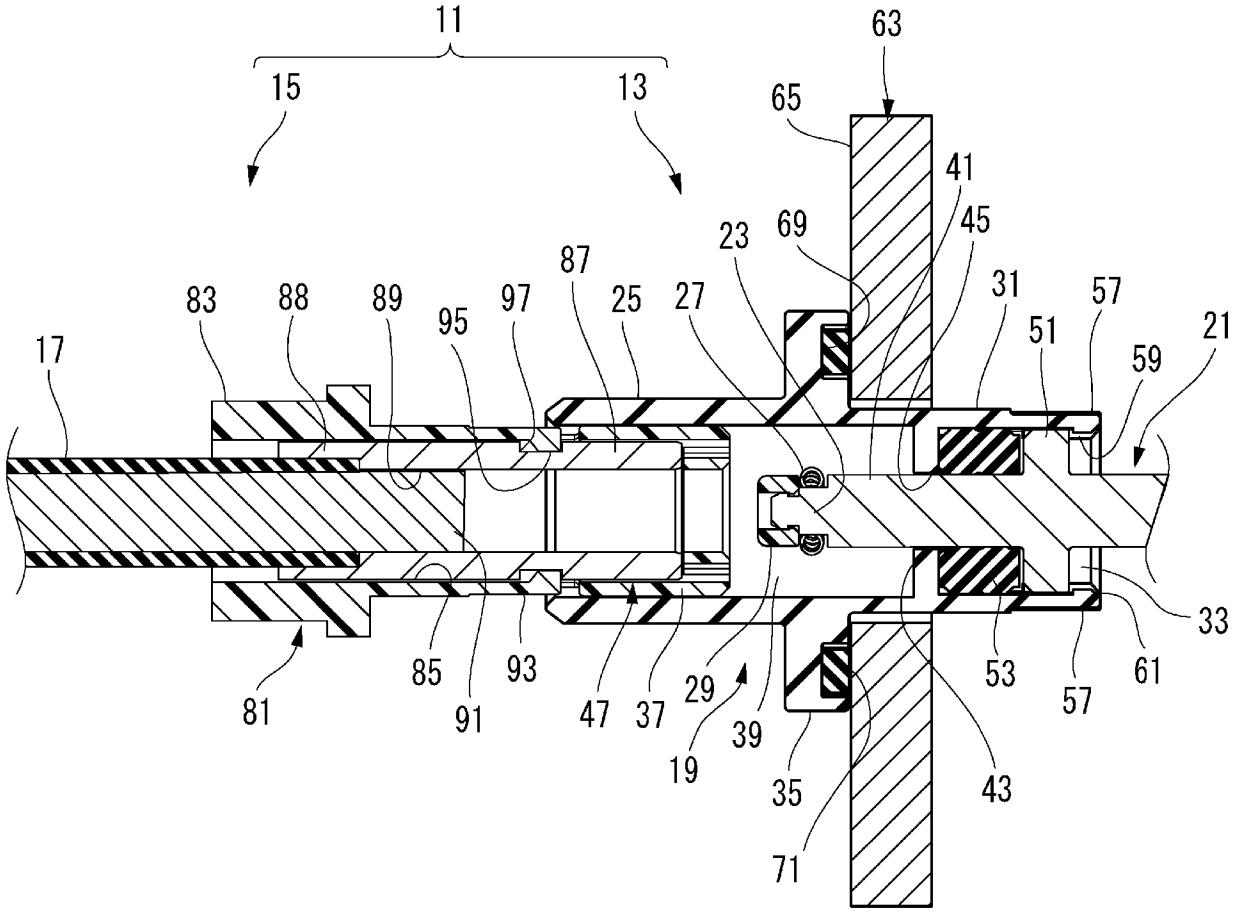
FIG. 5 is a longitudinal cross-sectional view of the male-female connecter during the fitting.

FIG. 5 is a longitudinal cross-sectional view of the male-female connecter 11 during the fitting.

In the male-female connecter 11, when the fitting is started, the female terminal accommodating portion 37 of the female housing 81 is inserted into the hood portion 25 of the male housing 19. The female terminal accommodating portion 37 is inserted into the fitting space 39 of the hood portion 25.

When the female terminal accommodating portion 37 is inserted into the fitting space 39, the male terminal 21 disposed coaxially with the fitting space 39 is disposed coaxially with the female terminal 47, and the electrical contact portion 41 of the male terminal 21 enters the electrical contact portion 87 of the female terminal 47 being guided by the insulating cap 29.

Figure 6:
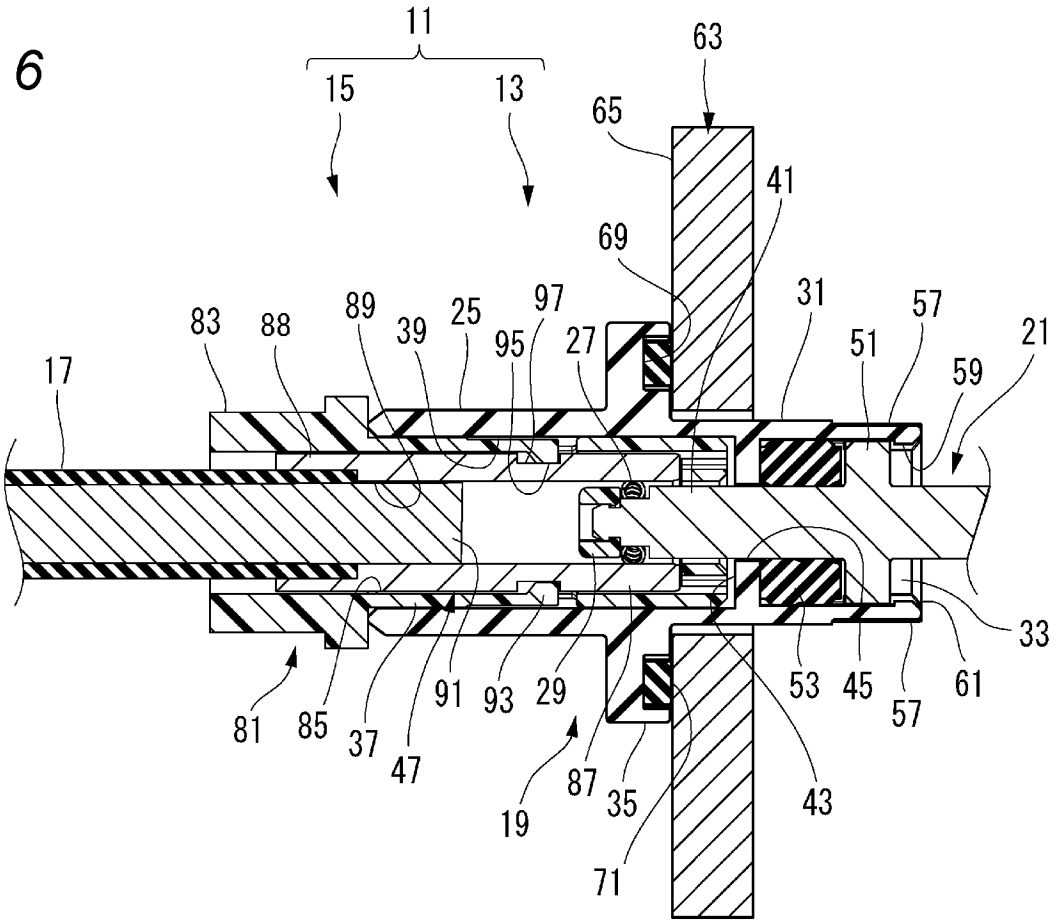
FIG. 6 is a longitudinal cross-sectional view of the male-female connecter after the fitting.

FIG. 6 is a longitudinal cross-sectional view of the male-female connecter 11 after the fitting.

In the electrical contact portion 41 of the male terminal 21 that enters the electrical contact portion 87 of the female terminal 47, the annular terminal spring 27 provided on the stepped shaft portion 23 contacts and is electrically connected to an inner periphery of the electrical contact portion 87 of the female terminal 47.

Next, an operation of the above configuration will be described.

Figure 7:
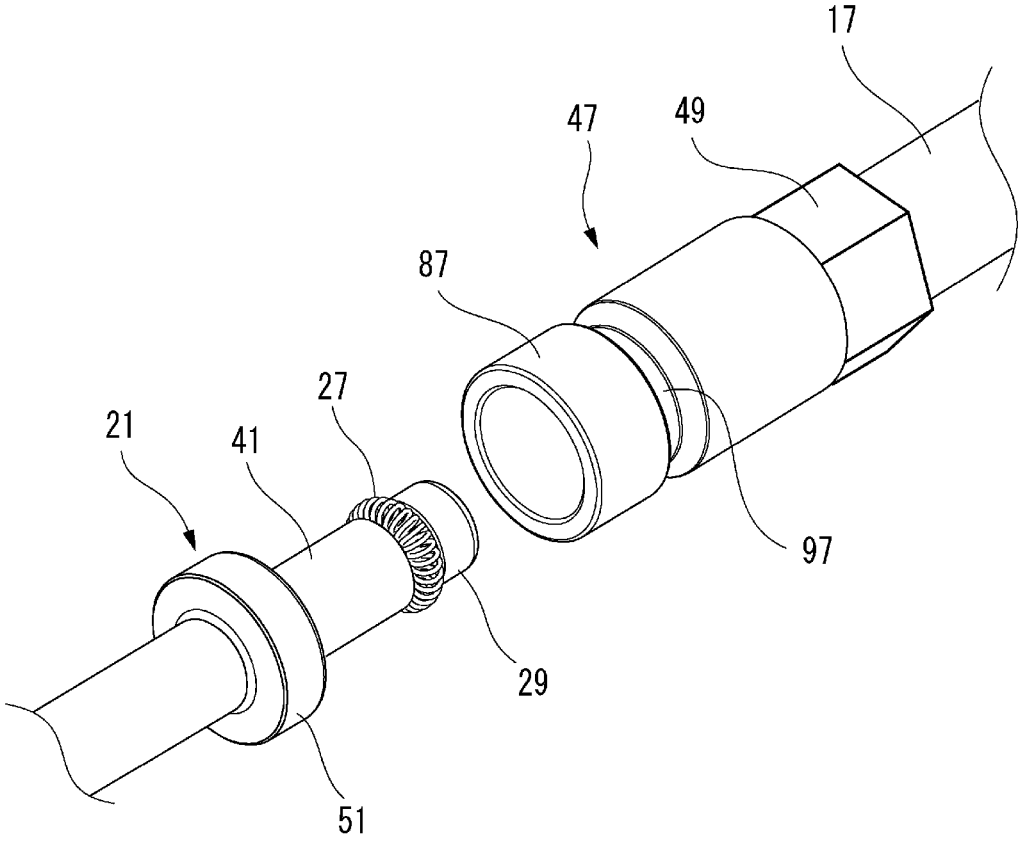
FIG. 7 is an exploded perspective view of the male terminal and the female terminal before the fitting.

FIG. 7 is an exploded perspective view of the male terminal 21 and the female terminal 47 before the fitting.

In the connecter terminal structure according to the present embodiment, a tip end of the male terminal 21 formed in the round bar shape serves as the electrical contact portion 41. The stepped shaft portion 23 (see FIG. 4A) is coaxially formed at the tip end of the electrical contact portion 41. The stepped shaft portion 23 has the stepped shape by coaxially extending the spring external fitting shaft portion 73 having a diameter smaller than that of the columnar electrical contact portion 41 forward on the tip end side of the electrical contact portion 41.

The insulating cap 29 made of the insulating resin is fixed to the tip end of the stepped shaft portion 23 to which the annular terminal spring 27 is externally fitted. Accordingly, the annular terminal spring 27 is regulated from slipping forward from the stepped shaft portion 23 by the insulating cap 29 and is regulated from being deviated rearward by the stepped shaft portion 23, and is held by the spring external fitting shaft portion 73.

On the other hand, the female terminal 47 has the electrical contact portion 87 formed in a cylindrical shape for receiving the electrical contact portion 41 externally fitted with the annular terminal spring 27. The inner diameter Df of the electrical contact portion 87 in the female terminal 47 is smaller than the outer diameter Dk of the annular terminal spring 27 (Df<Dk). That is, when the electrical contact portion 41 of the male terminal 21 to which the annular terminal spring 27 is externally fitted is inserted into the female terminal 47, the electrical contact portion 41 elastically deforms the annular terminal spring 27 in the reduced diameter direction, and is brought into conductive contact with an inner peripheral surface of the female terminal 47 with a predetermined pressing force via the annular terminal spring 27.

Figure 8A:
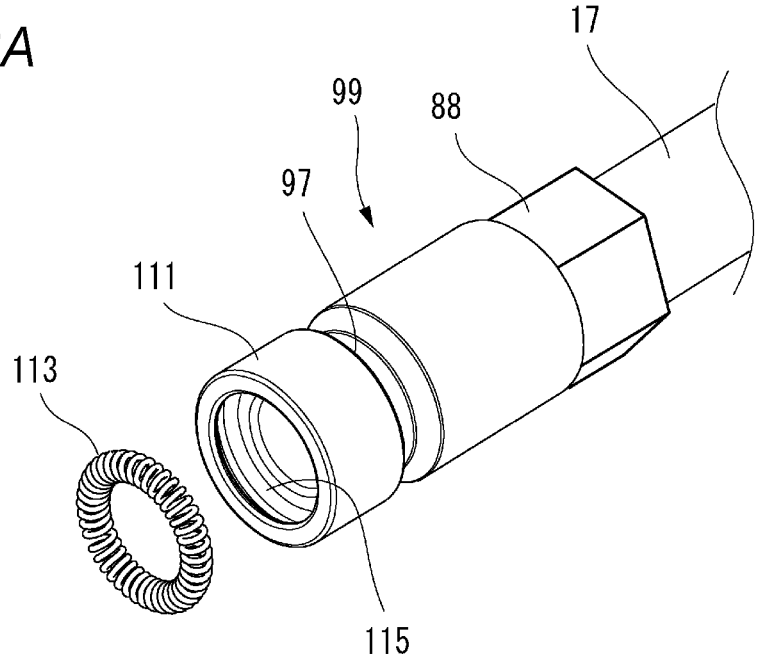
FIG. 8A is an exploded perspective view of a female terminal according to a reference example before an annular terminal spring is mounted.
Figure 8B:
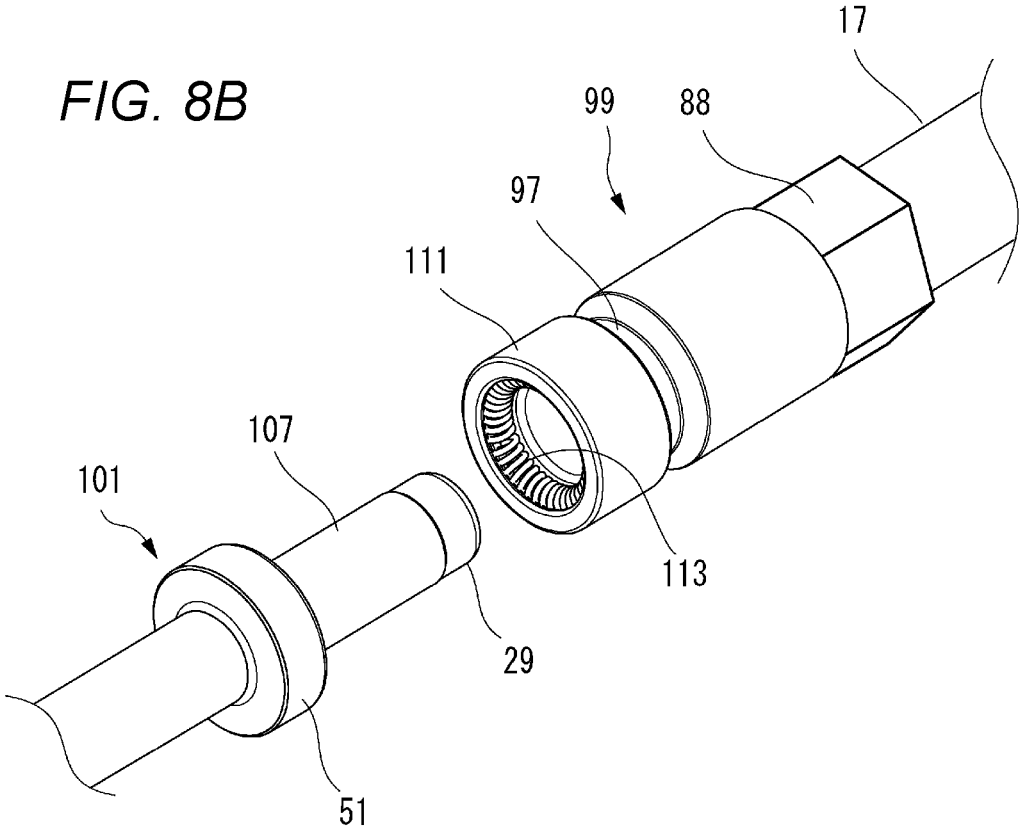
FIG. 8B is a perspective view of a male terminal according to the reference example and the female terminal according to the reference example before the fitting.
Figure 9:
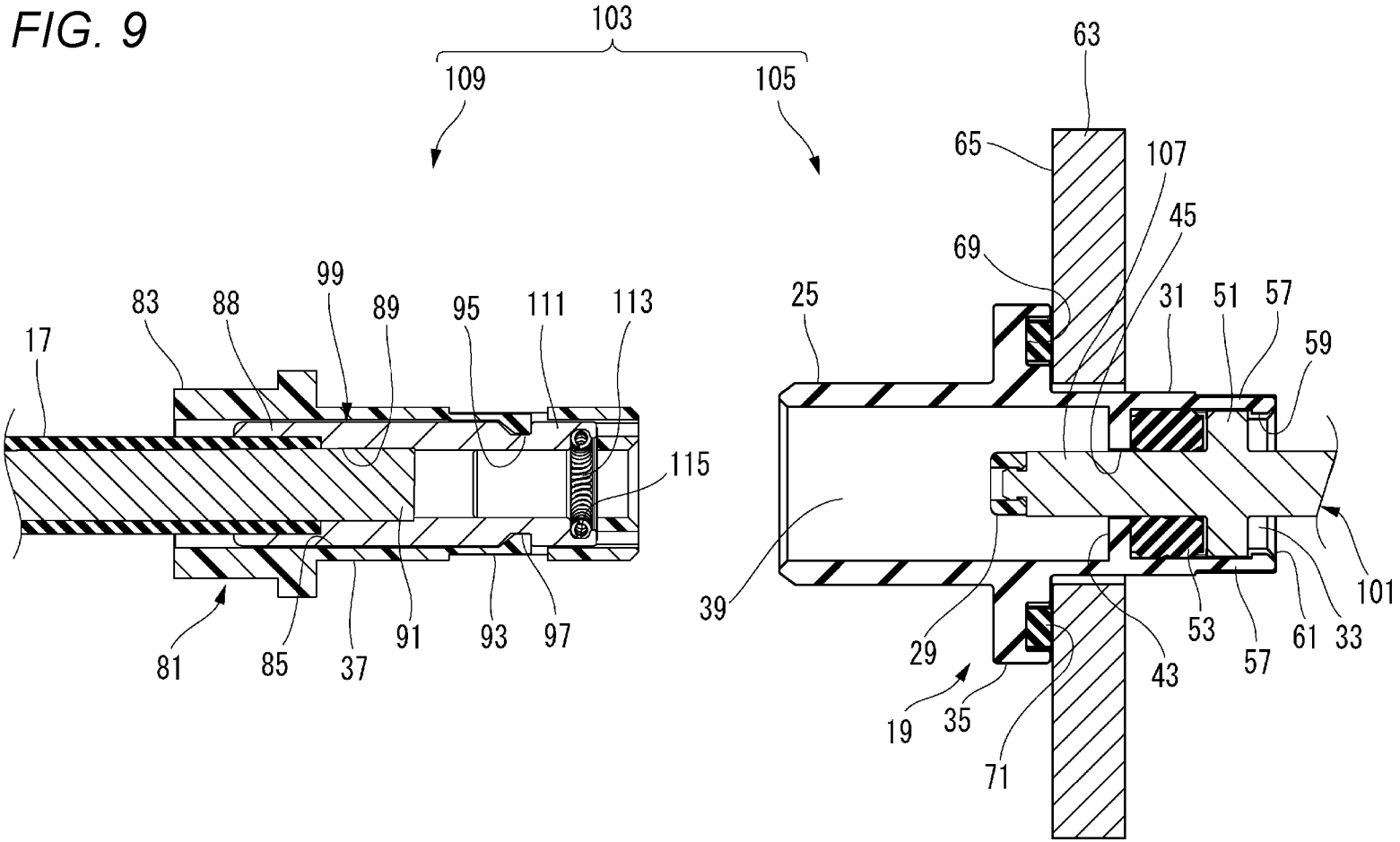
FIG. 9 is an exploded perspective view of a male-female connecter according to the reference example before the fitting.

FIG. 8A is an exploded perspective view of a female terminal 99 according to a reference example before an annular terminal spring 113 is mounted, and FIG. 8B is a perspective view of a male terminal 101 according to the reference example and the female terminal 99 according to the reference example before the fitting. FIG. 9 is an exploded perspective view of a male-female connecter 103 according to the reference example before the fitting.

With respect to the connecter terminal structure according to the present embodiment, in a connecter terminal structure according to the reference example shown in FIGS. 8A to 9, the male terminal 101 having a round bar-shaped electrical contact portion 107 is accommodated in a male connecter 105 of the male-female connecter 103. The annular terminal spring 27 is not provided in the electrical contact portion 107 of the male terminal 101. On the other hand, the cylindrical female terminal 99 is accommodated in the female terminal accommodating portion 37 of a female connecter 109. An annular terminal spring 113 is assembled inside an electrical contact portion 111 of the female terminal 99. The annular terminal spring 113 to be assembled to the female terminal 99 is assembled to a holding groove 115 formed by cutting and machining (boring) an inner wall surface of the female terminal 99 in a circumferential direction so as not to move in the female terminal 99 or come out of the female terminal 99.

Therefore, in the connecter terminal structure according to the present embodiment, the annular terminal spring 113 mounted on an inner periphery of the female terminal 99 is eliminated, and the annular terminal spring 27 is provided on the male terminal 21, so that it is not necessary to provide the holding groove 115 on the female terminal 47. Therefore, a cutting and machining operation is remarkably facilitated, and processing cost of the female terminal 47 can be reduced. The stepped shaft portion 23 must be cut and machined for the electrical contact portion 41 of the male terminal 21, but it is possible to easily perform outer rounding as compared with a method of boring the holding groove 115 of the female terminal 99 in the related art. In addition, the outer rounding can achieve a higher processing accuracy than the boring.

Further, since it is not necessary to assemble the annular terminal spring 113 inside the female terminal 47, and it is not necessary to form the holding groove 115 of the annular terminal spring 113 from the tip end of the female terminal 47 to a rear side at a predetermined distance or more, a length of the female terminal 47 can be shortened by that amount, and then a length of the male-female connecter 11 in the fitting direction at the time of fitting can be shortened.

Here, a relative positional deviation of the female terminal 47 and the male terminal 21 in a direction orthogonal to the axis is allowed in a range of (Dk−Dm)/2 (a displacement range of the annular terminal spring 27). The displacement range of the annular terminal spring 27 can be easily changed by design values of the outer diameter Ds of the spring external fitting shaft portion 73, which is the small diameter portion of the stepped shaft portion 23, and the average diameter Da of the coil spring. That is, in the connecter terminal structure according to the present embodiment, since the annular terminal spring 27 is externally fitted to the electrical contact portion 41 of the male terminal 21, a cutting and machining operation for easily changing the displacement range of the annular terminal spring 27 is easier than an operation for the holding groove 115 obtained by processing an inner peripheral surface of the female terminal 99.

In the connecter terminal structure according to the present embodiment, the annular terminal spring 27 can be mounted on the spring external fitting shaft portion 73 of the stepped shaft portion 23 from the front without increasing a diameter of the annular terminal spring 27. Accordingly, for example, as in the contact device disclosed in JP-A-2008-204634, since an operation of increasing the diameter of the spring contact (annular terminal spring 27) and then mounting the spring contact in the groove does not occur, it is possible to prevent damage or the like to the electrical contact portion 41 of the male terminal 21.

In the connecter terminal structure according to the present embodiment, the small diameter portion of the stepped shaft portion 23 serves as the spring external fitting shaft portion 73. The spring external fitting shaft portion 73 is further provided with the cap locking shaft portion 75 that extends coaxially toward the tip end side and has the diameter smaller than that of the spring external fitting shaft portion 73. The cap locking groove 77 is formed on the cap locking shaft portion 75 in the circumferential direction.

The insulating cap 29 made of an insulating resin is formed in a substantially cylindrical shape. An inner diameter of the insulating cap 29 is set to be equal to or slightly smaller than a diameter of the cap locking shaft portion 75. The insulating cap 29 is formed with the fixing claw 79 that protrudes toward an inner diameter side. When the insulating cap 29 is press-fitted to the cap locking shaft portion 75 from the front, the fixing claw 79 is elastically deformed to be locked to the cap locking groove 77. When the fixing claw 79 is locked to the cap locking groove 77, the insulating cap 29 is fixed to the cap locking shaft portion 75. Accordingly, the annular terminal spring 27 is sandwiched between the electrical contact portion 41 and the insulating cap 29, and is fixed to the tip end of the stepped shaft portion 23.

Therefore, in the connecter terminal structure according to the present embodiment, since the annular terminal spring 27 can be held by the stepped shaft portion 23 by press-fitting and locking the insulating cap 29 to the tip end of the stepped shaft portion 23, the annular terminal spring 27 can be easily attached to the tip end of the electrical contact portion 41 without increasing the diameter of the annular terminal spring 27. Since the fixing is completed only by press-fitting the insulating cap 29 into the cap locking shaft portion 75 from the front, automation when attaching the annular terminal spring 27 to the male terminal 21 can be facilitated.

Therefore, according to the connecter terminal structure according to the present embodiment, processing cost of the terminal can be reduced by simplifying the shape of the female terminal 47 and the length of the male-female connecter 11 in the fitting direction at the time of the fitting can be shortened by eliminating the holding groove 115 of the female terminal 47.

The present disclosure is not limited to the above embodiment, and modifications, improvements, and the like can be made as appropriate. In addition, materials, shapes, dimensions, numbers, arrangement positions or the like of elements in the embodiment described above are optional and not limited as long as the present disclosure can be achieved.

As described above, a connecter terminal structure includes: a male housing 19 of a male connecter 13; a male terminal 21 accommodated in the male housing 19, the male terminal 21 having a bar shape and including a first electrical contact portion (for example, an electrical contact portion 41); a stepped shaft portion 23 formed at a tip end of the first electrical contact portion of the male terminal 21; a hood portion 25 formed in the male housing 19 and surrounding the first electrical contact portion; an annular terminal spring 27 including a coil spring having conductivity and being bent in an annular shape with both end portions being joined, the annular terminal spring 27 being externally fitted to the stepped shaft portion 23; an insulating cap 29 fixed to a tip end of the stepped shaft portion 23 and configured to hold the annular terminal spring 27; a female housing 81 of a female connecter 15; a female terminal accommodating portion 37 formed in the female housing 81 and configured to be fitted into the hood portion 25; and a female terminal 47 to be accommodated in the female terminal accommodating portion 37 and including a second electrical contact portion (for example, an electrical contact portion 87), the second electrical contact portion having a tubular shape to allow the first electrical contact portion to be inserted therein.

According to the connecter terminal structure, a terminal spring mounted on an inner periphery of the female terminal is eliminated, and the annular terminal spring is provided on the male terminal. Accordingly, since it is not necessary to provide a holding groove in the female terminal, a cutting and machining operation is remarkably facilitated, and processing cost of the female terminal can be reduced. The stepped shaft portion must be cut and machined in the first electrical contact portion of the male terminal, but it is possible to easily perform outer rounding as compared with a method of boring the holding groove of the female terminal in the related art. In addition, the outer rounding can achieve a higher processing accuracy than the boring.

Further, since it is not necessary to assemble the terminal spring inside the female terminal, and it is not necessary to form the holding groove of the terminal spring from a tip end of the female terminal to a rear side at a predetermined distance or more, a length of the female terminal can be shortened by that amount, and then a length of a male-female connecter in a fitting direction at the time of fitting can be shortened.

Here, a relative positional deviation of the female terminal and the male terminal in a direction orthogonal to an axis is allowed in a displacement range of the annular terminal spring. The displacement range of the annular terminal spring can be easily changed by design values of an outer diameter of a small diameter portion of the stepped shaft portion and an average diameter of the coil spring. That is, in the connecter terminal structure, since the annular terminal spring is externally fitted to the first electrical contact portion of the male terminal, a cutting and machining operation for changing the displacement range of the annular terminal spring is easier than an operation for the holding groove obtained by processing an inner peripheral surface of the female terminal.

In the connecter terminal structure, the annular terminal spring can be mounted on the small diameter portion of the stepped shaft portion from a front without increasing a diameter of the annular terminal spring. Accordingly, for example, as in the contact device disclosed in JP-A-2008-204634, since an operation of increasing the diameter of the spring contact (annular terminal spring) and then mounting the spring contact in the groove does not occur, it is possible to prevent damage or the like to the electrical first contact portion of the male terminal.

In the connecter terminal structure, the stepped shaft portion 23 includes: a spring external fitting shaft portion 73 extending coaxially from the first electrical contact portion toward a tip end side and having a diameter smaller than an outer diameter of the first electrical contact portion; and a cap locking shaft portion 75 extending coaxially from the spring external fitting shaft portion 73 toward the tip end side and has a diameter smaller than that of the spring external fitting shaft portion 73. A cap locking groove 77 is formed on the cap locking shaft portion 75 in a circumferential direction. The insulating cap 29 has a tubular shape and includes a fixing claw 79 provided on an inner periphery of the insulating cap 29. The fixing claw 79 is configured to be locked to the cap locking groove 77.

According to the connecter terminal structure, the spring external fitting shaft portion is provided with the cap locking shaft portion that extends coaxially toward the tip end side and has a diameter smaller than that of the spring external fitting shaft portion. The cap locking groove is formed on the cap locking shaft portion in the circumferential direction. An inner diameter of the insulating cap is set to be equal to or slightly smaller than a diameter the cap locking shaft portion. The insulating cap is formed with the fixing claw that protrudes toward an inner diameter side. When the insulating cap is press-fitted to the cap locking shaft portion from the front, the fixing claw is elastically deformed to be locked to the cap locking groove. When the fixing claw is locked to the cap locking groove, the insulating cap is fixed to the cap locking shaft portion. Accordingly, the annular terminal spring is sandwiched between the first electrical contact portion and the insulating cap, and is fixed to the tip end of the stepped shaft portion.

In the connecter terminal structure, since the annular terminal spring can be held by the stepped shaft portion by press-fitting and locking a resin cap to the tip end of the stepped shaft portion, the annular terminal spring can be easily attached to the tip end of the first electrical contact portion without increasing the diameter of the annular terminal spring. Since the fixing is completed only by press-fitting the insulating cap into the cap locking shaft portion from the front, automation when attaching the annular terminal spring to the male terminal can be facilitated.

The invention claimed is:

1. A connecter terminal structure comprising:

a male housing of a male connecter;

a male terminal accommodated in the male housing, the male terminal having a bar shape and comprising a first electrical contact portion;

a stepped shaft portion formed at a tip end of the first electrical contact portion of the male terminal;

a hood portion formed in the male housing and surrounding the first electrical contact portion;

an annular terminal spring comprising a coil spring having conductivity and being bent in an annular shape with both end portions being joined, the annular terminal spring being externally fitted to the stepped shaft portion;

an insulating cap fixed to a tip end of the stepped shaft portion and configured to hold the annular terminal spring;

a female housing of a female connecter;

a female terminal accommodating portion formed in the female housing and configured to be fitted into the hood portion; and a female terminal accommodated in the female terminal accommodating portion and comprising a second electrical contact portion, the second electrical contact portion having a tubular shape to allow the first electrical contact portion to be inserted therein, wherein the stepped shaft portion includes a cap locking groove, wherein the insulating cap comprises a fixing claw provided on an inner periphery of the insulating cap, and wherein the fixing claw is configured to be locked to the cap locking groove.

2. The connecter terminal structure according to claim 1, wherein the stepped shaft portion comprises:

a spring external fitting shaft portion extending coaxially from the first electrical contact portion toward a tip end side and having a diameter smaller than an outer diameter of the first electrical contact portion; and a cap locking shaft portion extending coaxially from the spring external fitting shaft portion toward the tip end side and has a diameter smaller than that of the spring external fitting shaft portion, wherein the cap locking groove is formed on the cap locking shaft portion in a circumferential direction, wherein the insulating cap has a tubular shape.

* * * * *